US008846206B2

(12) United States Patent
James et al.

(10) Patent No.: US 8,846,206 B2
(45) Date of Patent: Sep. 30, 2014

(54) INJECTION MOLDED COMPONENT

(75) Inventors: Allister W. James, Orlando, FL (US); Douglas J. Arrell, Ovieco, FL (US)

(73) Assignee: Siemens Energy, Inc., Orlando, FL (US)

( * ) Notice: Subject to any disclaimer, the term of this patent is extended or adjusted under 35 U.S.C. 154(b) by 1230 days.

(21) Appl. No.: 12/183,185

(22) Filed: Jul. 31, 2008

(65) Prior Publication Data

US 2010/0028163 A1 Feb. 4, 2010

(51) Int. Cl.

| | |
|---|---|
| ***F04D 29/58*** | (2006.01) |
| ***B23P 15/04*** | (2006.01) |
| ***C22C 19/03*** | (2006.01) |
| ***C22C 19/07*** | (2006.01) |

(52) U.S. Cl.

CPC ..... *C22C 19/03* (2013.01); *C22C 19/07* (2013.01)

USPC ..... 428/553; 428/546; 419/5; 419/8

(58) Field of Classification Search

USPC ..... 428/544, 546, 553; 419/1, 3, 5, 8; 416/96; 29/889

See application file for complete search history.

(56) References Cited

U.S. PATENT DOCUMENTS

| | | | | |
|---|---|---|---|---|
| 4,023,249 | A * | 5/1977 | Darrow et al. | 29/889.721 |
| 5,328,331 | A | 7/1994 | Bunker et al. | |
| 5,640,767 | A | 6/1997 | Jackson et al. | |
| 5,820,337 | A | 10/1998 | Jackson et al. | |
| 5,960,249 | A * | 9/1999 | Ritter et al. | 419/6 |
| 6,000,908 | A | 12/1999 | Bunker | |
| 6,168,871 | B1 * | 1/2001 | Ritter et al. | 428/548 |
| 6,238,182 | B1 * | 5/2001 | Mayer | 416/96 A |
| 6,347,660 | B1 | 2/2002 | Sikkenga et al. | |
| 6,403,153 | B1 * | 6/2002 | Frul | 427/203 |
| 6,607,355 | B2 | 8/2003 | Cunha et al. | |
| 2006/0026833 | A1 * | 2/2006 | Imbourg et al. | 29/890.01 |
| 2006/0163222 | A1 * | 7/2006 | Dance et al. | 219/121.69 |
| 2010/0028131 | A1 * | 2/2010 | Arrell et al. | 415/115 |

* cited by examiner

*Primary Examiner* — Mark Ruthkosky
*Assistant Examiner* — Julia L Rummel

(57) ABSTRACT

An intermediate component includes a first wall member, a leachable material layer, and a precursor wall member. The first wall member has an outer surface and first connecting structure. The leachable material layer is provided on the first wall member outer surface. The precursor wall member is formed adjacent to the leachable material layer from a metal powder mixed with a binder material, and includes second connecting structure.

18 Claims, 3 Drawing Sheets

INJECTION MOLDED COMPONENT

This invention was made with U.S. Government support under Contract Number DE-FC26-05NT42644 awarded by the U.S. Department of Energy. The U.S. Government has certain rights to this invention.

This application is related to U.S. patent application Ser. No. 12/183,168, filed concurrently herewith, entitled "COMPONENT FOR A TURBINE ENGINE", the entire disclosure of which is incorporated by reference herein.

FIELD OF THE INVENTION

The present invention generally relates to components for use in a gas turbine engine, and more particularly, to components comprising a first wall member and an injection molded second wall member.

BACKGROUND OF THE INVENTION

U.S. Pat. No. 5,328,331 discloses an airfoil comprising an integrally formed double shell outer wall surrounding an inner cavity. Airfoils of this type have been developed to increase engine efficiency by maximizing cooling efficiency. However, airfoils of this type can be difficult to manufacture, and spacing between the outer and inner walls is generally too great, which may reduce cooling efficiency. Additionally, it may be undesirable to form the integral outer and inner walls from a common material.

Metal injection molding can be used to produce components having complex geometric shapes. Finished parts produced by metal injection molding can exhibit mechanical properties near those of the base material in its wrought form and can have densities approaching those of the base material.

SUMMARY OF THE INVENTION

In accordance with one aspect of the present invention, an intermediate component comprises a first wall member, a leachable material layer, and a precursor wall member. The first wall member comprises an outer surface and first connecting structure. The leachable material layer is provided on the first wall member outer surface. The precursor wall member is formed adjacent to the leachable material layer from a metal powder mixed with a binder material. The precursor wall member includes second connecting structure.

The first connecting structure may comprise a plurality of cavities extending inwardly from the first wall member outer surface. The second connecting structure may comprise a plurality of connecting elements having securing portions at ends thereof located within corresponding ones of the first wall member cavities.

The first material may comprise a nickel-based superalloy or a cobalt-based superalloy and the second material may comprise an aluminide or a material comprising Cr, Al, and at least one of Fe, Co, and Ni.

The securing portion of at least one of the connecting elements may be tail shaped and at least one of the cavities may define a socket to receive the tail-shaped securing portion.

The connecting element may comprise an intermediate portion integral with the tail-shaped securing portion. The intermediate portion may have first and second parts. The first part may have a width dimension greater than a width dimension of the second part such that a step is formed where the first and second parts meet. The step may engage the first surface of the first member when the tail-shaped securing portion is positioned in the socket.

The tail-shaped securing portion may be tapered in a direction toward the first surface of the first member.

The intermediate portion of the connecting element may comprise an opening through which cooling fluid is permitted to flow from cooling passages defined on opposing sides of the intermediate portion.

The socket may comprise a stop for engaging an end of the tail-shaped securing portion.

The leachable material layer may have a thickness of between about 0.5 mm and about 3 mm.

The leachable material layer may be formed from a ceramic material.

In accordance with another embodiment of the invention, a method of forming an intermediate component for use in a turbine engine is provided. The method comprises providing a first wall member comprising a first surface and first connecting structure, providing a leachable material layer on the first wall member first surface, and disposing a metal powder over the leachable material layer capable of forming a second wall member comprising a shell and second connecting structure.

The first connecting structure may comprise a plurality of cavities extending inwardly from the first wall member outer surface. The second connecting structure may comprise a plurality of connecting elements having securing portions at ends thereof located within corresponding ones of the first wall member cavities.

A binder material may be mixed with the metal powder.

The connecting elements may comprise intermediate portions integral with the securing portions, and each of the intermediate portions may extend through a corresponding slot provided in the leachable layer.

In accordance with yet another embodiment of the invention, a method of forming a component is provided. The method comprises providing a first wail member comprising a first surface and first connecting structure, providing a leachable material layer on the first wall member first surface, placing the first wall member having the leachable material layer thereon in a mold such that a portion of the mold is spaced a predefined distance from the leachable material layer, injecting a metal powder mixed with a binder material into the mold capable of forming a second wail member, and removing the leachable material layer. The second wall member may comprise a shell and second connecting structure that cooperates with the first wall member first connecting structure to attach the second wall member to the first wall member.

The metal powder and binder material mixture may be heated to remove substantially all of the binder material.

The metal powder may be sintered to solidify the metal powder to form the second wall member.

A hot isostatic pressing process may be employed to fill voids created by heating the metal powder and binder material mixture and/or sintering the metal powder.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
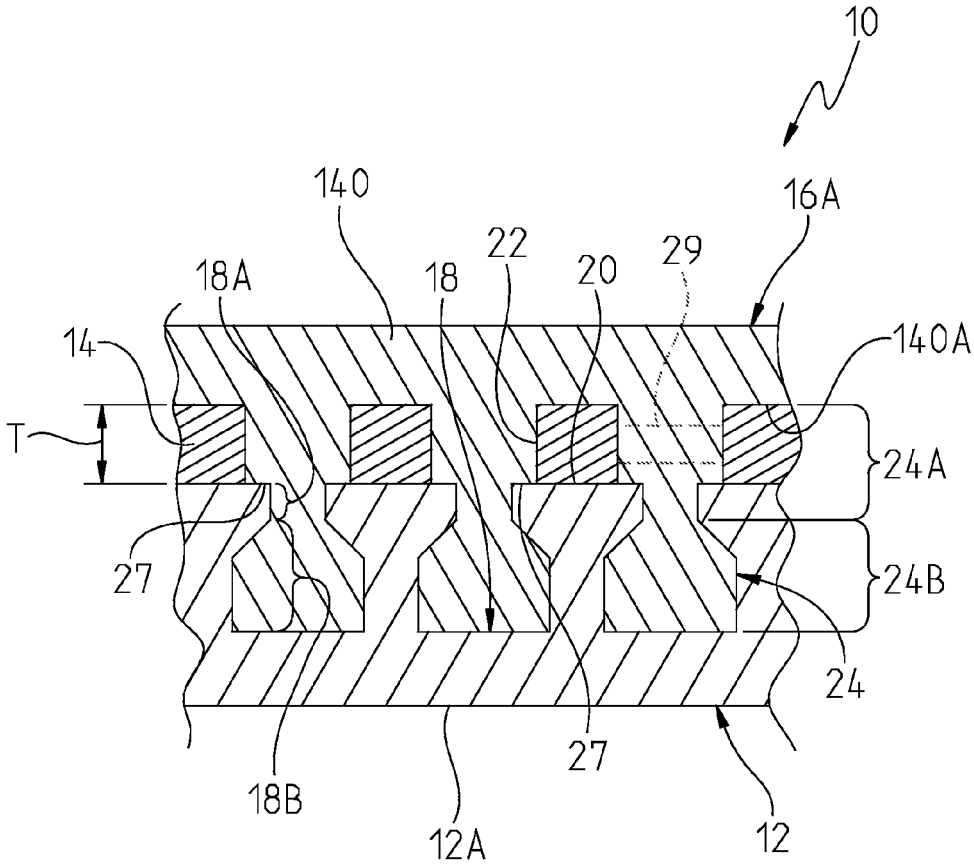
FIG. 1 is a side cross sectional view of a portion of an intermediate component for use in a turbine engine according to an embodiment of the invention.
Figure 4:
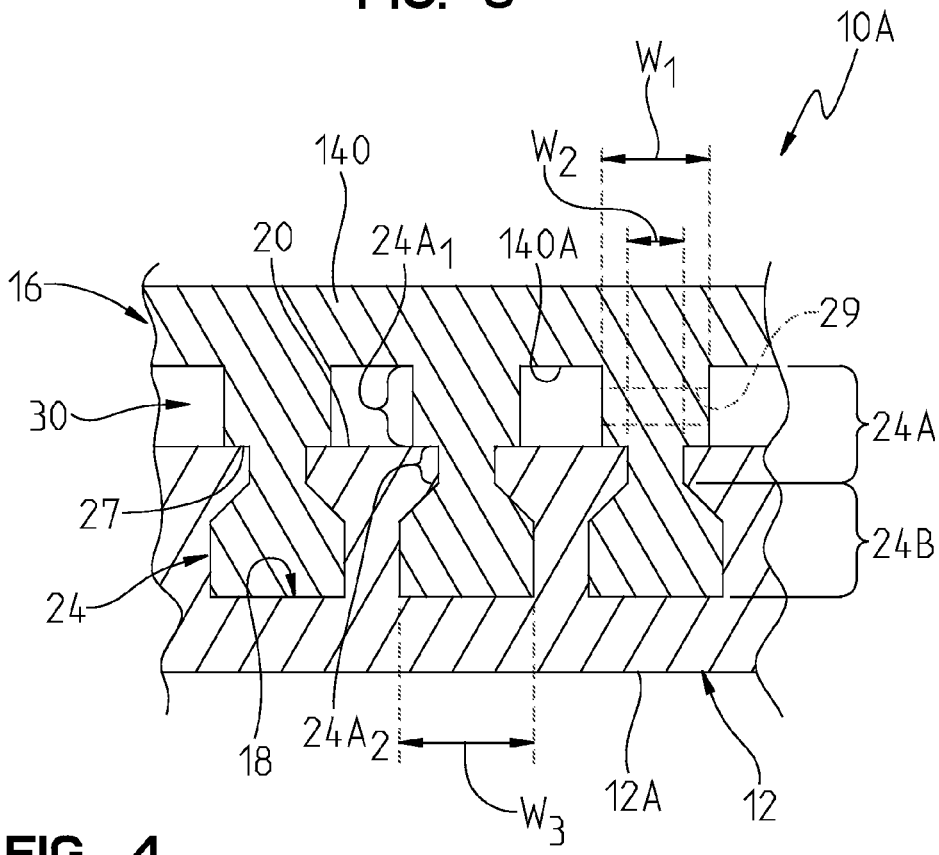
FIG. 4 is a side cross sectional view of a portion of a completed component formed after post-injection procedures have been performed on the component illustrated in FIG. 1.

FIG. 1 illustrates an intermediate component 10 which is adapted to be formed into a completed component 10A, see FIG. 4, for use in a turbine engine. The completed component 10A may comprise, for example, a turbine blade, a turbine vane, a turbine ring segment, a combustor (annular or can-annular), or a transition duct. The intermediate component 10 comprises a first wall member 12, a temporary leachable material layer 14, and a precursor wall member 16A to be formed into a second wall member 16.

The first wall member 12 is formed, for example, from a nickel-based superalloy or cobalt-based superalloy, such as a nickel-based superalloy CM 247 LC (CM 247 LC is a registered trademark of Cannon-Muskegon Corporation of Muskegon, Mich.) or a nickel-based superalloy sold as "INCONEL alloy" (INCONEL is a registered trademark of Special Metals Corporation). Nickel-based superalloys and cobalt-based superalloys demonstrate very good properties under temperatures of about 1000° C., including, for example, excellent mechanical strength. For example, the nickel-base superalloy CM 247 LC exhibits an ultimate tensile strength (UTS) of approximately 1000 MPa at a temperature of 800° C., falling to approximately 550 MPa at a temperature of 1000° C. A cobalt-base alloy X-45 exhibits a UTS of approximately 400 MPa at a temperature of 800° C. falling to approximately 130 MPa at a temperature of 1000° C.

Figure 2:
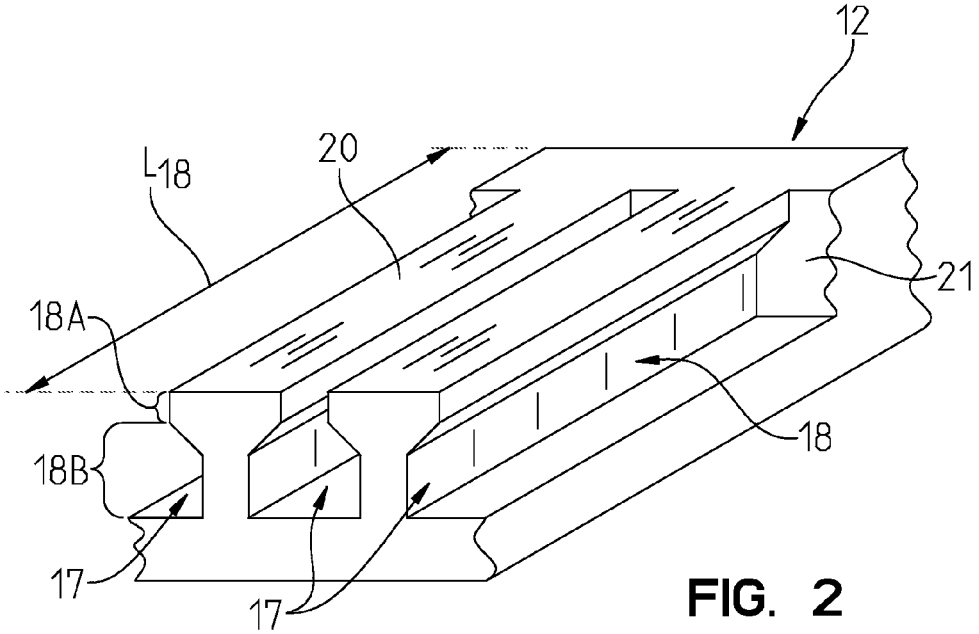
FIG. 2 is a perspective view of a portion of a first wall member of the intermediate component illustrated in FIG. 1.
Figure 3:
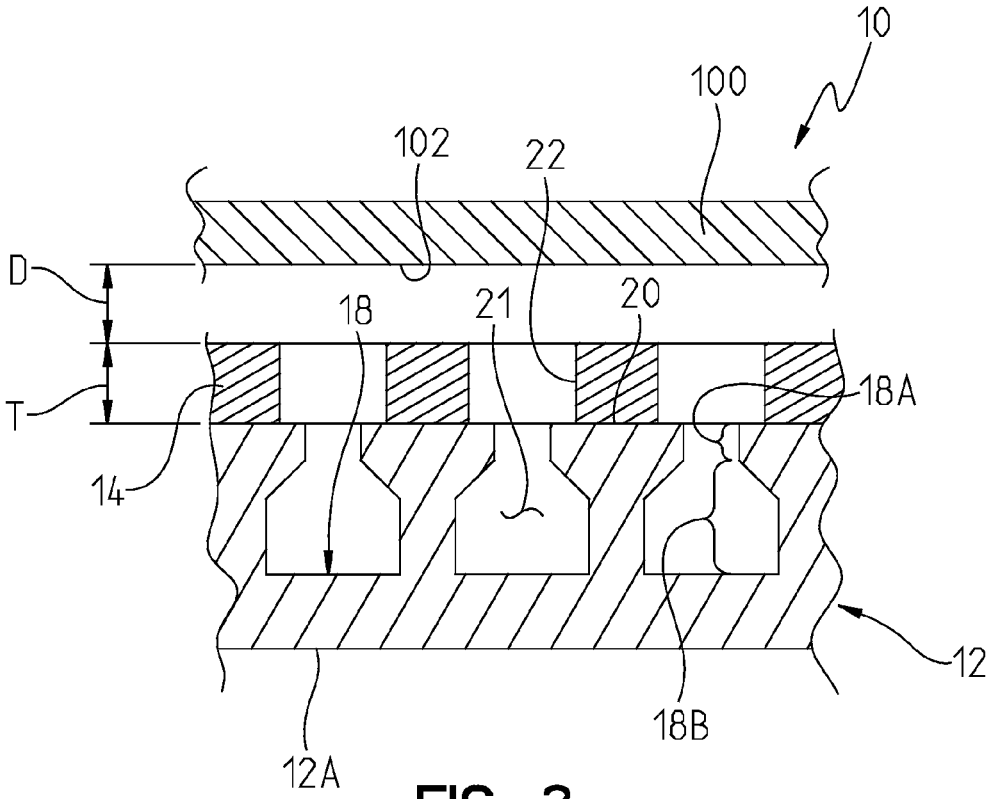
FIG. 3 is a side cross sectional view of a portion of the component illustrated in FIG. 1 prior to formation of a second wall member.

The first wall member 12 includes first connecting structure comprising a plurality of elongate cavities 18 extending inwardly from an outer surface 20, as more clearly shown in FIGS. 2 and 3. The cavities 18 may be configured to define a series of elongate rows or columns, as shown in FIG. 2, or be formed in other suitable configurations. As shown in FIGS. 1-3, the cavities 18 comprise a first area 18A defining an entrance portion of the cavity 18, and a second area 18B defining a socket of the cavity 18. The second area 18B is tapered toward the outer surface 20 of the first wall member 12. Each cavity 18 includes a stop 21 formed at an end thereof see FIG. 2.

As seen in FIGS. 1 and 3, the leachable material layer 14 is formed over the outer surface 20 of the first wall member 12. In the embodiment shown, the leachable material layer 14 is formed from a monolithic ceramic material, such as alumina, although any suitable material may be used. The leachable material layer 14 preferably has a thickness T of between about 0.5 mm and about 3 mm, but may be slightly thicker or slightly thinner without departing from the scope and spirit of the invention. The leachable material layer 14 may be arranged over substantially the entire outer surface 20 of the first wall member 12 or over a selected portion or portions of the outer surface 20 of the first wall member 12. As more clearly shown in FIG. 3, slots 22 are formed in the leachable material layer 14 that are generally aligned with the cavities 18 formed in the first wall member 12 such that the leachable material layer 14 does not cover the cavities 18. In the illustrated embodiment, one or more of the slots 22 are slightly wider than the first areas 18A of the cavities 18, see FIG. 3.

The leachable material layer 14 may be formed over the outer surface 20 of the first wall member 12 using any suitable process. For example, the first wall member 12 may be placed into a mold (not shown) and a ceramic slurry may be injected under pressure into the mold so as to flow over the outer surface 20 of the first wall member 12. The cavities 18 of the first wall member 12 may be filled or otherwise blocked to prevent the ceramic slurry from entering the cavities 18. Blocking the cavities 18 may be performed, for example, by filling the cavities 18 or blocking at least the entrance portions of the cavities 18 with a temporary material, such as, for example, a synthetic wax. The temporary material should extend a desired distance past, i.e., out from, the outer surface 20 of the first wall member 12 such that the ceramic slurry is not injected into locations corresponding to the slots 22. The slurry may be cured such as by heating to form the solidified leachable material layer 14. The temporary material may be removed, such as by melting or burning away the temporary material, to unblock the cavities 18 after the ceramic slurry has solidified so that the second wall member 16 may be formed. Alternatively, the leachable material layer 14 could be disposed on the outer surface 20 of the first wall member 12 as a solid ceramic member having a shape corresponding to the outer surface 20 of the first wall member 12, such that the cavities 18 are not covered. A glue may be used to bond the solid ceramic member to the outer surface 20 of the first wall member 12.

Referring back to FIG. 1, the precursor member 16A is formed over the leachable material layer 14 by a suitable process such as, for example, a metal injection molding process, to be discussed below. For example, a mixture may be prepared comprising a binder material and a metal powder. The binder material may comprise a wax e.g., a synthetic material wax, or a polymeric material e.g., polyethylene. The metal powder may be an aluminide e.g., NiAl or $Ni_3Al$, or a MCrAl-based material, where M may be Fe, Co, Ni, or a combination of two or more of Fe, Co, Ni. Other alloying additions, such as rare earth elements e.g., hafnium, cerium, neodymium, or lanthanum may also be included. For example, hafnium or neodymium may be added in amounts of up to about 2% by weight of the metal powder, and up to several hundred ppm of lanthanum and/or cerium may be added. The mixture may comprise about 60 percent metal powder by volume and about 40 percent binder material by volume, but may have other suitable volume combinations. The mixture may be hot mixed, for example, at a temperature within a range of from about 140° C. to about 200° C., to produce a viscous homogeneous mixture.

It is believed that the materials comprising the metal powder have very good high temperature characteristics and properties after sintering, including, for example, excellent oxidation resistance and corrosion resistance at temperatures of up to at least 1400° C. The excellent oxidation resistance and corrosion resistance is believed to result due to the formation of a stable coherent alumina film formed on the surface of the second wall member 16 at high temperatures, as is known in the art. It is understood that the low temperature (e.g. below 1000° C.) mechanical strength of the material forming the first wall member 12 may be greater than the mechanical strength of the material forming the second wall member 16. For example, PM2000 (manufactured by Plansee), an oxide dispersion strengthen heat resistant Fe—Cr—Al alloy, exhibits a UTS of approximately 120 MPa and 90 MPa at temperatures of 800° C. and 1000° C., respectively. The material from which the second wall member 16 is formed may have a coefficient of thermal expansion much lower than that of the material from which the first wall member 12 is formed. For example, the coefficient of thermal expansion of FeCrAl is about $10\times10^{-6}$ per ° C. at room temperature, while the coefficient of thermal expansion of INCONEL 718 is about $12\times10^{-6}$ per ° C. at room temperature. It is believed to be advantageous to form the first and second wall members 12, 16 from materials having different coefficients of thermal expansion because the operating temperature the first wall member 12 is typically exposed to in a gas turbine engine is about 1000° C., and the operating temperature the second wall member 16 is typically exposed to is about 1150° C. Since the second wall member 16 is formed from a material having a lower coefficient of thermal expansion than that of the first wall member 12, the first and second wall members 12, 16 may expand/contract about the same amount during turbine operation in their respective temperature ranges, which reduces thermal strain and stress on the first and second wall members 12, 16.

As noted above, the precursor wall member 16A may be formed via an injection molding process. The first wall member 12 and the leachable material layer 14 are placed in a mold 100, see FIG. 3, such that an inner surface 102 of the mold 100 is located a predefined distance D from the leachable material layer 14. The mixture of metal powder and binder material is then injected under pressure into the mold 100. Optionally, the first wall member 12 and leachable material layer 14 may be heated to a temperature of about 150° C. while the mixture is being injected such that the mixture flows more freely into and substantially fills the cavities 18. The mixture may then be allowed to cool to form the precursor wall member 16A having a thickness corresponding to the distance D between the mold 100 and the leachable material layer 14. It is noted that the binder material, once cooled, functions to bind the metal powder together until the metal powder is sintered, as will be discussed further below, so as to form the second wall member 16.

As seen in FIG. 4, the second wall member 16 comprises a plate-like portion 140, which may define an outer shell of a vane or blade. The outer shell is adapted to be exposed to high temperature gases during operation of a gas turbine engine in which the vane or blade is used. The second wall member 16 further includes second connecting structure comprising a plurality of connecting elements 24 extending from an inner surface 140A of the plate-like member 140. The connecting elements 24 have a length substantially equal to a length $L_{18}$ of a corresponding cavity 18, wherein the length $L_{18}$ extends from an entrance 17 of the cavity 18 to the stop 21, as shown in FIG. 2. The connecting elements 24 extend through corresponding slots 22 formed in the leachable material layer 14 and into corresponding cavities 18 formed in the first wall member 12.

In the illustrated embodiment, each of the connecting elements 24 comprises an intermediate portion 24A and a securing portion 24B. The intermediate portion 24A extends from the inner surface 140A of the plate-like member 140 and is integral with a corresponding securing portion 24B. In the embodiment shown, each intermediate portion 24A comprises first and second parts $\mathbf{24}A_1$ and $\mathbf{24}A_2$, respectively, wherein a step 27 is defined where the first and second parts $\mathbf{24}A_1$, $\mathbf{24}A_2$ meet. The step 27 is formed due to the first part $\mathbf{24}A_1$ of the intermediate portion 24A having a width dimension $W_1$ that is slightly greater than a width dimension $W_2$ of the second part $\mathbf{24}A_2$. As shown in FIG. 4, the steps 27 engage the outer surface 20 of the first wall member 12 such that the first parts $\mathbf{24}A_1$ of the connecting elements 24 are prevented from entering the first areas 18A of the cavities 18. It is understood that only a selected number of connecting elements 24 may include the step 27, including an embodiment where none of the connecting elements 24 include the step 27.

As a result of the injection molding process, each securing portion 24B substantially conforms to the tapered shape of the second area 18B of its corresponding cavity 18, thus giving the securing portion 24B a tapered tail-shape. Since the securing portions 24B have a width $W_3$ greater than a width of the first areas 18A of the cavities 18 (which correspond to the width $W_2$ of the second parts $\mathbf{24}A_2$ of the connecting elements 24), the securing portions 24B are retained in the cavities 18 of the first wall member 12 so as to secure the second wall member 16 to the first wall member 12.

Optionally, an opening 29 may be formed in the first part $\mathbf{24}A_1$ of at least one connecting element 24, see FIGS. 1 and 4, by configuring the mold 100 such that the metal powder and binder material mixture is not injected into the area corresponding to the opening 29. Alternatively, the leachable material layer 14 may be formed to include structure corresponding to the opening 29, such that the opening 29 is formed after removing the leachable material layer 14, as will be described below. The opening 29 may allow cooling fluid to flow therethrough between cooling passages 30 defined between the first and second wall members 12, 16 on opposing sides of the connecting element 24.

A substantial portion or all of the binder material of the precursor wall member 16A is removed in a debinding process by heating the component 10 to a temperature, for example, from between about 550° C. to about 650° C. During the debinding process, substantially all organic material in the binder material pyrolizes and the metal powder partially sinters leaving a partially sintered metal powder forming the precursor wall member 16A.

It is noted that the precursor wall member 16A may shrink as a result of the removal of the binder material during the debinding process. It is further noted that as a result of the debinding process, voids (not shown) may be formed in the precursor wall member 16A due to the removal of the binder material. These voids are preferably removed during a sintering process, to be described below.

During the sintering process, the component 10 is heated to a temperature, for example, of between about 1200° C. and about 1250° C., depending upon the materials from which the first and second wall members 12, 16 are formed. The sintering process removes substantially any remaining binder material not removed during the debinding process and further sinters the metal powder particles of the precursor wall member 16A, thus filling the voids and completely solidifying the precursor wall member 16A. The solidified precursor wall member 16A defines the second wall member 16. The sintering process may be controlled such that the resulting second wall member 16 achieves a density that is within a range of between about 95 percent to about 99 percent of a density of the base material from which the metal powder is made in a solid, non-powder form.

After the sintering process, the leachable material layer 14 is removed from the component 10 in any suitable manner to form the completed component 10A, as illustrated in FIG. 4. For example, the component 10 may be dipped in a solution of sodium hydroxide, wherein the solution effectively dissolves the leachable material layer 14 while leaving the first and second wall members 12, 16 interconnected and substantially unaltered. As a result of removing the leachable material layer 14, cooling passages 30 are formed between the outer surface 20 of the first wall member 12, the inner surface 140A of the plate-like member 140, and the connecting elements 24, as shown in FIG. 4. During operation of the turbine engine, cooling fluid is circulated through the cooling passages 30 and through the openings 29 such that energy in the form of heat is transferred, such as from the second wall member 16, to the cooling fluid so as to cool the second wall member 16, which, as noted above, may define an outer shell of a vane or blade exposed to high temperature gases during operation of a gas turbine engine in which the vane or blade is incorporated. Heat may also be transferred from the first wall member 12 to the cooling fluid.

A hot isostatic pressing process e.g., an isotropic process may be performed to further increase the density of the completed component 10A up to about 100 percent of a density of the base material from which the metal powder is made in a solid, non-powder form. During the hot isostatic pressing process, heat and high pressure are applied to the completed component 10A in a high temperature furnace enclosed in a pressure vessel. As the completed component 10A is heated, an inert gas, e.g., argon, may apply a substantially uniform pressure to the completed component 10A. The hot isostatic pressing process causes consolidation of the material forming the second wall member 16 and fills any remaining voids not filled by the sintering process. The temperature, pressure, and process time can all be controlled to achieve the optimum material properties of the completed component 10A.

It is noted that the preferred exemplary order for performing the debinding of the component 10, sintering of the component 10, removal of the leachable material layer 14, and the hot isostatic pressing process described above is not considered to be limiting. For example, the leachable material layer 14 may be removed after the debinding process and prior to the sintering process.

As an alternative to the injection molding process described above for forming the precursor wall member 16A, metal powder alone e.g., without a binder material, may be disposed onto the leachable material layer 14 and into the cavities 18 of the first wall member 12 in the form of a loose metal powder, such as by using a shaking procedure. The first wall member 12 and the leachable material layer 14 may be vibrated while the loose metal powder is disposed so that the metal powder flows freely into and substantially fills the cavities 18. It is expected that applying a metal powder without a binder material will result in less shrinkage of the powder during subsequent debinding and sintering processes, thus reducing the size and number of voids formed in the cavities 18 and increasing the strength of the completed component 10A. It is noted that since the binder material is not present to partially solidify the precursor wall member 16A after the shaking procedure, the precursor wall member 16A must be sintered before removing the leachable material layer 14, as the loose metal powder, if not solidified during the sintering process, may be removed during the removal of the leachable material layer 14.

The second wall member 16 may define a thermal shield for the first wall member 12 from high temperature gases moving through the turbine section of a gas turbine engine. Further, since the first wall member 12 is maintained at a much lower temperature than the second wall member 16 during turbine engine operation, the first wall member 12 may be formed from a material, such as one of the materials set out above, having excellent strength properties at temperatures equal to or less than about 1000 degrees C. and, hence, provide the majority of the mechanical strength to support the completed component 10A in the turbine section. Because the first wall member 12 provides the majority of the strength required to support the completed component 10A in the turbine section, the second wall member 16 may be made from a material which has less strength but better oxidation and corrosion resistance when exposed to the high temperature gases in the turbine section of the gas turbine engine.

Additionally, the distance D between the outer surface 20 of the first wall member 12 and the inner surface 140A of the plate-like member 140 in the illustrated embodiment is believed to be less than that of prior art single construction components. Therefore, cooling efficiency provided to the first and second wall members 12, 16 is believed to be enhanced, since a reduced amount of cooling fluid can be provided to the cooling passages 30 while providing substantially the same amount of cooling to the first and second wall members 12, 16 as in prior art components. Specifically, it has been found that a 25% reduction in the amount of cooling fluid can be provided to the cooling passages 30 while maintaining the cooling of the first and second wall members 12, 16 at or near that of prior art components. The reduced amount of cooling fluid used to cool the first and second wall members 12, 16, while maintaining cooling to the first and second wall members 12, 16, increases the cooling efficiency of the completed component 10A.

Bores (not shown) may be provided in the first member 12 to allow cooling fluid to enter the cooling passages 30 from an inner cavity defined by an inner surface 12A of the first member 12. The inner cavity may be supplied with the cooling fluid in a manner known to those skilled in the art.

While not illustrated, bores may be formed through the second member 16 which define pathways for cooling air to exit corresponding cooling passages 30 and pass through and out from the second member 16 so as to provide an outer film cooling layer for the component 10A.

Figure 5:
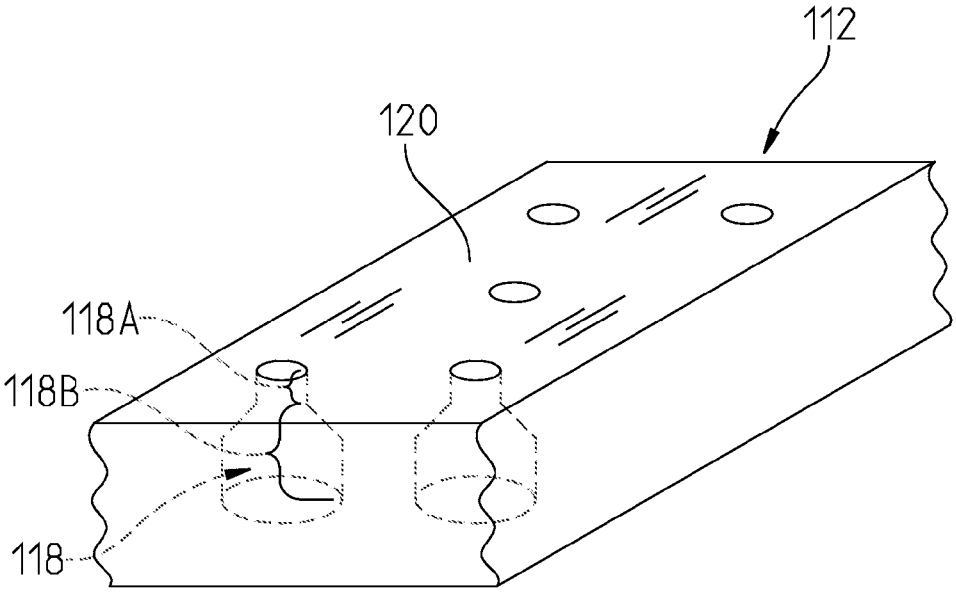
FIG. 5 is a perspective view of a portion of a first wall member of an intermediate component in accordance with another embodiment of the invention.

FIG. 5 illustrates a first wall member 112 for use in a gas turbine engine constructed in accordance with a further embodiment of the present invention. In this embodiment, corresponding structure to that described above with reference to FIGS. 1-4 is identified by the same reference numeral increased by 100. In this embodiment, first connecting structure comprising cavities 118 are formed in the first wall member 112 that extend inwardly from a first wall member outer surface 120. The cavities 118 comprise substantially circular shaped and individually formed openings in the outer surface 120 of the first wall member 112 and include substantially cylindrical first portions 118A and tapered second portions 118B. When a second wall member (not shown in this embodiment) is formed using a suitable process, such as the injection molding process described above, connecting elements of the second wall member substantially conform to the size and shape of the cavities 118 of the first wall member 112.

In this embodiment, cooling fluid used to cool the first wall member 112 and the second wall member can pass between intermediate portions of the connecting elements of the second wall member to cool the first wall member 112 and the second wall member without the openings 29 shown in FIG. 1. Optionally, the cavities 118 may be arranged in a staggered pattern as shown in FIG. 5 to maximize cooling by creating a more turbulent flow path for the cooling fluid.

Figure 6:
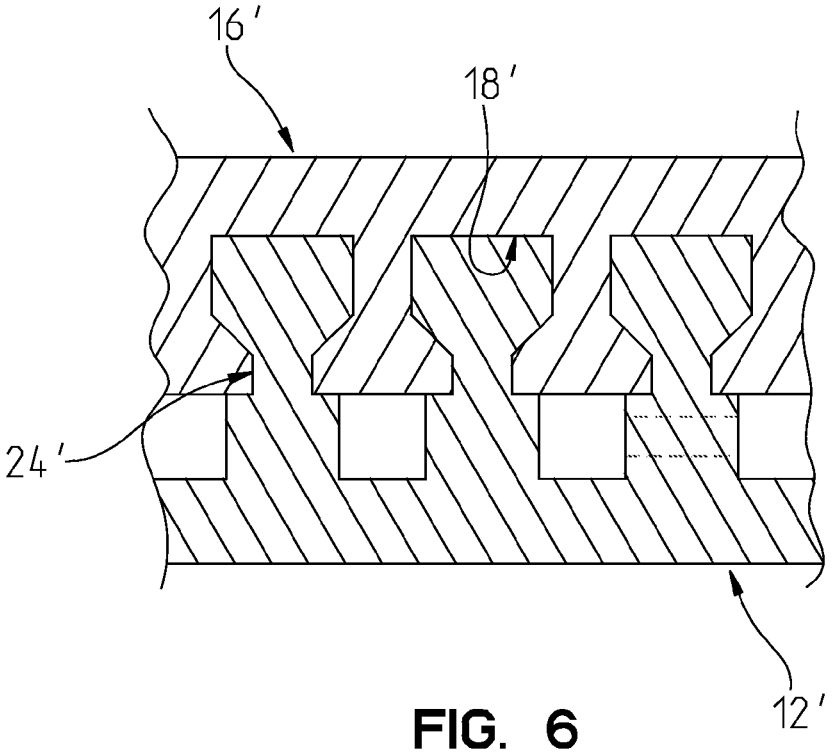
FIG. 6 is a perspective view of a portion of a first wall member of an intermediate component in accordance with another embodiment of the invention.

While the first connecting structure comprising the cavities 18 has been shown as being formed in the first wall member 12 and the second connecting structure comprising the connecting elements 24 has been illustrated as being part of the second wall member 16, it is understood that the first connecting structure of the first wall member 12 may comprise connecting elements and the second connecting structure of the second wall member 16 may comprise cavities. For example, in FIG. 6, the first wall member 12' comprises connecting elements 24' and the second wall member 16' comprises cavities 18'. The first wall member 12' may be formed from the same materials from which the first wall member 12 illustrated in FIG. 4 is formed and the second wall member 16' may be formed from the same materials from which the second wall member 16 illustrated in FIG. 4 is formed. An outer surface of the second wall member 16' is intended to be exposed to high temperature gases during operation of the gas turbine engine.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An intermediate component for the production of a turbine engine component comprising:

a first wall member comprising a first connecting structure comprising a plurality of elongated projections and a plurality of elongated cavities located between said projections;

a leachable material layer provided on the outermost surface of said projections and between said cavities wherein said leachable material layer includes slots that are generally aligned with said cavities such that the leachable material layer does not cover or extend into said cavities; and a precursor wall member formed adjacent to said leachable material layer from a metal powder mixed with a binder material, said precursor wall member including a second connecting structure that extends into and substantially fills said cavities and engages the first connecting structure in a mechanically locking relationship; wherein a plurality of cooling channels is defined upon removal of the leachable material layer.

2. The intermediate component as set out in claim 1, wherein said second connecting structure comprises a plurality of connecting elements having securing portions at ends thereof located within corresponding ones of said first wall member cavities to secure said first wall member to said precursor wall member.

3. The intermediate component as set out in claim 2, wherein said first wall member is formed from a first material and said metal powder is formed from a second material, and wherein said first material is one of a nickel-based superalloy and a cobalt-based superalloy and said second material comprises one of an aluminide and a material comprising Cr, Al, and at least one of Fe, Co, and Ni.

4. The intermediate component as set out in claim 2, wherein said securing portion of at least one of said connecting elements is tail shaped and at least one of said cavities defines a socket to receive said tail-shaped securing portion.

5. The intermediate component as set out in claim 4, wherein said at least one connecting element further comprises an intermediate portion integral with said tail-shaped securing portion, said intermediate portion having first and second parts, said first part having a width dimension greater than a width dimension of said second part such that a step is formed where said first and second parts meet, said step engaging said outermost surface of said projections of first wall member when said tail-shaped securing portion is positioned in said socket.

6. The intermediate component as set out in claim 5, wherein said tail-shaped securing portion is tapered in a direction toward said outermost surface of said projections of first wall member.

7. The intermediate component as set out in claim 5, wherein said intermediate portion of said at least one connecting element comprises an opening through which cooling fluid is permitted to flow from cooling passages defined on opposing sides of said intermediate portion.

8. The intermediate component as set out in claim 4, wherein said socket comprises a stop for engaging an end of said tail-shaped securing portion.

9. The intermediate component as set out in claim 2, wherein said leachable material layer is formed from a ceramic material and has a thickness between about 0.5 mm and about 3 mm.

10. A method of forming an intermediate component for the production of a turbine engine component comprising:

providing a first wall member comprising a first connecting structure comprising a plurality of elongated projections and a plurality of elongated cavities located between said projections;

providing a leachable material layer on the outermost surface of said projections and between said cavities wherein said leachable material layer includes slots that are generally aligned with said cavities such that the leachable material layer does not cover or extend into said cavities; and disposing a metal powder mixed with a binder material over the leachable material layer capable of forming a second wall member comprising a shell and a second connecting structure that extends into and substantially fills said cavities and engages the first connecting structure in a mechanically locking relationship; wherein a plurality of cooling channels is defined upon removal of the leachable material layer.

11. The method of claim 10, wherein:

the first wall member is formed from one of a nickel-based superalloy and a cobalt-based superalloy;

the metal powder comprises one of an aluminide and a material comprising Cr, Al, and at least one of Fe, Co, and Ni and further comprising a binder material mixed with the metal powder;

the second connecting structure comprises a plurality of connecting elements, the connecting elements comprising securing portions located at ends thereof; and the securing portions are formed in corresponding ones of the cavities of the first wall member.

12. The method of claim 11, wherein the connecting elements further comprise intermediate portions integral with the securing portions, each of the intermediate portions extending through a corresponding slot provided in the leachable layer.

13. A method of forming a component for use in a turbine engine comprising:

providing a first wall member comprising a first connecting structure comprising a plurality of elongated projections and a plurality of elongated cavities located between said projections;

providing a leachable material layer on the outermost surface of said projections and between said cavities wherein said leachable material layer includes slots that are generally aligned with said cavities such that the leachable material layer does not cover or extend into said cavities;

placing the first wall member having the leachable material layer thereon in a mold such that a portion of the mold is spaced a predefined distance from the leachable material layer;

injecting a metal powder mixed with a binder material into the mold capable of forming a second wall member comprising a shell and a second connecting structure that extends into and substantially fills said cavities and cooperates with the first connecting structure to attach the second wall member to the first wall member by engaging the first connecting structure in a mechanically locking relationship; and removing the leachable material layer such that a plurality of cooling channels is defined upon removal of the leachable material layer.

14. The method of claim 13, wherein the second connecting structure comprises a plurality of connecting elements, the connecting elements comprising securing portions located at ends thereof, wherein the securing portions are formed in corresponding ones of the cavities of the first wall member.

15. The method of claim 13, further comprising heating the metal powder and binder material mixture to remove substantially all of the binder material.

16. The method of claim 15, further comprising sintering the metal powder to solidify the metal powder to form the second wall member.

17. The method of claim 16, further comprising employing a hot isostatic pressing process to fill voids created by at least one of said heating the metal powder and binder material mixture and said sintering the metal powder.

18. The method of claim 10, wherein disposing a metal powder over the leachable material layer comprises disposing the metal powder through the slots in the leachable material layer and into the cavities of the first wall member.

* * * * *